United States Patent [19]

Coxhill et al.

[11] 4,039,151

[45] Aug. 2, 1977

[54] IMPELLER LOCKING MEANS FOR IMPACT CRUSHER ROTOR

[75] Inventors: Major Coxhill; Jerome R. Unger; Keith B. Lowe, all of Appleton, Wis.

[73] Assignee: Allis-Chalmers Corporation, Milwaukee, Wis.

[21] Appl. No.: 721,173

[22] Filed: Sept. 7, 1976

[51] Int. Cl.[2] ..... B02C 13/06

[52] U.S. Cl. ..... 241/191

[58] Field of Search ..... 241/189 R, 191, 192, 241/294

[56] References Cited

U.S. PATENT DOCUMENTS

| | | | |
|---|---|---|---|
| 2,258,075 | 10/1941 | Symons | 241/191 |
| 3,146,961 | 9/1964 | Putman, Jr. | 241/294 X |
| 3,455,517 | 7/1969 | Gilbert | 241/191 X |
| 3,874,603 | 4/1975 | Lowe | 241/191 |

*Primary Examiner*—Roy Lake
*Assistant Examiner*—Howard N. Goldberg
*Attorney, Agent, or Firm*—Robert C. Jones

[57] ABSTRACT

A locking means for the impellers of an impact crusher rotor is disclosed wherein the impellers are partly within axially extending peripheral slots which are diametrically opposite each other; semi-cylindrical cavities are formed in the face of the leading wall and the face of the impeller which cooperate to define a cylindrical bore extending parallel to the axis of the rotor; within the cylindrical bore a wedge lock is inserted which is a two-part device each having a flat surface complementary to each other and machined at an angle to the outside diameter of the composite wedge lock; the diameters of the outer surface of each wedge portion is centered at different locations thereby effectively preventing rotation of the wedge lock; a key on the convex surface of the smaller wedge portion cooperate with a recess formed in the semi-cylindrical cavity of the face of the leading wall to prevent axial movement of the wedge portion; a knock-out rod is provided to release the wedge lock for replacing of the impeller.

5 Claims, 5 Drawing Figures

IMPELLER LOCKING MEANS FOR IMPACT CRUSHER ROTOR

BACKGROUND OF THE INVENTION

1. Field of the Invention

This invention relates to impact crushers which have a rotor carrying impellers arranged to strike and throw rock to disintegrate upon impact with target members spaced from the rotor, and in particular to an improved arrangement for attaching impellers to the rotor.

2. Description of the Prior Art

It has long been known to provide the rotor of impact crushers with easily replaceable impellers, by inserting the impellers endwise into axially extending peripheral slots which in end view appear as a dovetail (or partial dovetail), and with centrifugal force acting to wedge the impellers into seating engagement with slot walls. An example of such a crusher is the machine shown in a patent assigned to Allis-Chalmers Manufacturing Company, U.S. Pat. No. 1,331,969 of Feb. 24, 1920. However, as explained in U.S. Pat. No. 2,310,758 of Feb. 9, 1943, it was considered desirable to hold such impellers against very large centrifugal forces, by clamping arrangements acting with dovetail slots and having bolts in a plane perpendicular to the rotor axis. Other U.S. Pat. Nos. disclosing such arrangements include 2,747,803 of May 29, 1956; 2,767,928 of Oct. 23, 1956; 2,862,669 of 1958; and 3,151,816 of 1964.

Another clamping arrangement for holding impellers in dovetail slots involves members having wedging surfaces and movable by bolts parallel to the rotor axis. There are many U.S. Pat. Nos. showing such arrangements, including 2,192,606 and 2,223,584 of 1940; 2,258,075 of 1941; 2,325,605 of 1943; 2,373,691 and 2,378,475 of 1945; 2,486,421 of 1949; 2,585,943 and 2,588,434 of 1952; 2,646,224 of 1953; 3,096,035 of 1963; 3,146,961 of 1964; 3,202,368 of 1965; 3,295,773 of 1967; 3,455,517 of 1969 and 3,874,603 of 1975.

As will appear from the description of the present invention to follow, the object of the present invention is to provide a new and improved arrangement of the last-mentioned type. Of the prior patents referred to, it is believed that the most pertinent to the present invention are U.S. Pat. No. 2,258,075 and U.S. Pat. No. 3,874,603. U.S. Pat. No. 2,258,075 shows several arrangements including one in which a pair of conical members are drawn toward each other along an axis parallel to the rotor axis to lock hammers with rotor slots. U.S. Pat. No. 3,874,603, discloses a two-piece bushing fitted within the cylindrical cavity at each end of a rotor, and each of the bushings comprises a pair of bushing halves each having a convex semi-cylindrical outer surface. The bushing halves are arranged within the cylindrical cavity with one convex surface engaging the impeller defined portion of the cavity and the other convex surface engaging the slot wall defined portion of the cavity, and with a diametrical plane along which the bushing is split into halves being substantially parallel to the adjacent leading impeller face. The halves of each bushing defined therebetween an internal conical shaped cavity with an apex end pointed inwardly of the adjacent end of the rotor. A frusto conical plug is inserted into each bushing with apex ends pointed inwardly of adjacent ends of the rotor. A rod passes through central bores in both plugs, and nuts threaded on both rod ends hold the plugs relative to each other.

SUMMARY OF THE PRESENT INVENTION

In a preferred arrangement of the present invention, an impact crusher having a rotor which is equipped with a pair of impeller bars with each impeller partly within a diametrically disposed axially extending peripheral slots. A portion of the leading face of each of the impellers within a slot and a facing wall of the slot cooperate to define between them a generally cylindrical cavity which is parallel to an axis about which the rotor rotates. A bushing portion is fitted within the cylindrical cavity at each end of each impeller. Two wedge bars having in cross-section a semi-circular configuration are fitted within the cylindrical cavity at each end of the rotor. Each bushing is split longitudinally to form a pair of wedges, one being larger than the other and each of which present a convex semi-cylindrical outer surface and a flat inner surface. A semi-cylindrical sleeve is fitted within the cylindrical cavity in the impeller to provide a bearing surface. The two-piece bushing is arranged within the cylindrical cavity with the larger being received in the sleeve. Stops are provided to limit movement of the smaller bushings inwardly of their respective rotor ends. The two-piece wedges forming each bushing cooperate to become self-locking and self-adjusting; i.e. as the impeller is distorted due to work induced metal flow, the two-piece wedges retain their fitted relationship within the cylindrical cavity. However, the larger of the wedges is free to move longitudinally when looseness occurs between the wedge pairs. This large wedge can be moved inwardly to take up clearance due to the facing tapered surface of the wedges themselves. Since one wedge is free to move relative to the other, a self-locking effect is obtained which operates to maintain the impeller in the rotor under all conditions.

DESCRIPTION OF THE INVENTION

Figure 1:
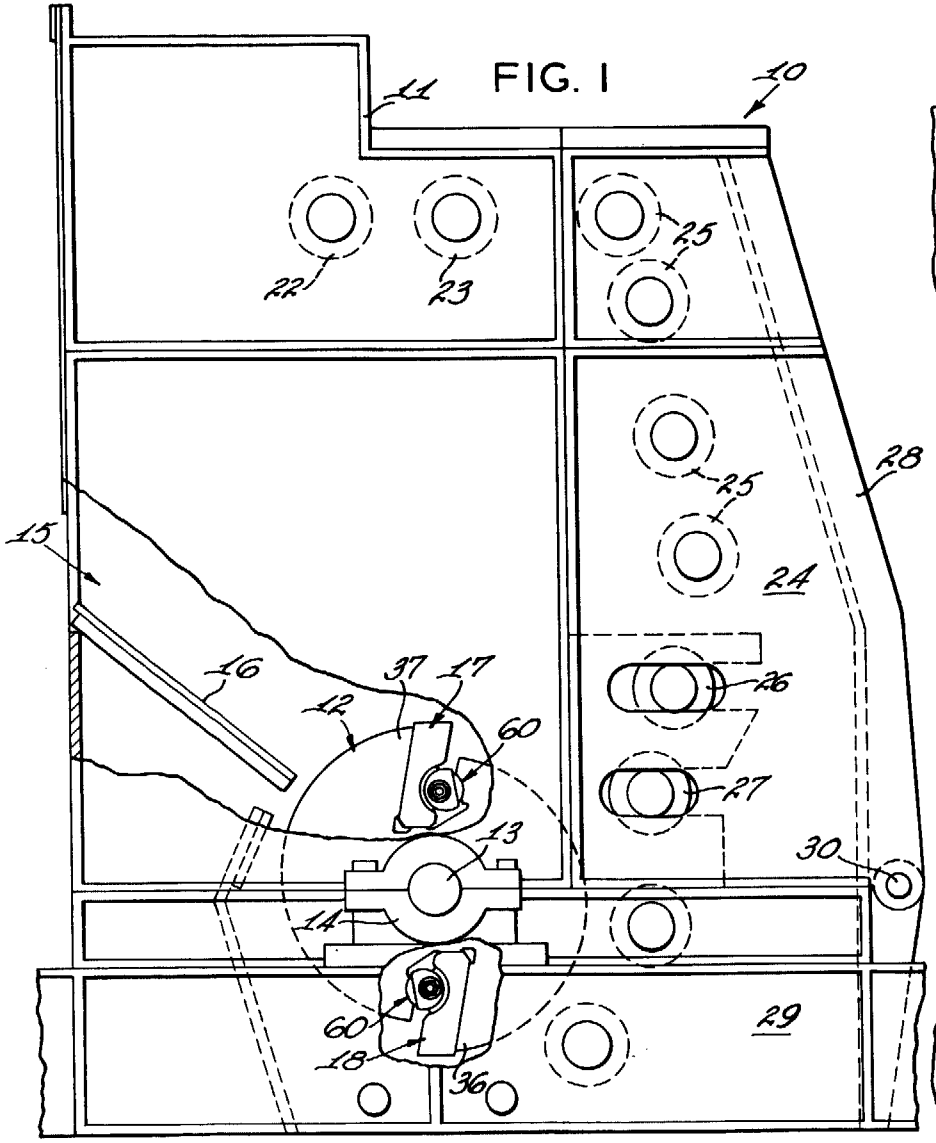
FIG. 1 is a view in elevation and partly in section of an impact crusher incorporating the features of the present invention.

Referring to FIG. 1, an impact crusher 10 is shown including a housing 11 having within a lower area thereof a rotor 12 mounted on a shaft 13 that is journalled in suitable bearings 14. The housing 11 defines a material feed opening 15 providing access to a downwardly sloping feed chute 16 leading toward the rotor 12. The feed chute 16 delivers rocks to impellers or hammers 17 and 18 which are carried by the rotor 12.

Feed chute 16 directs feed rock to rotor 12 at a location where the impellers 17 and 18 are ascending with the result that the impact of the impellers on the feed rock breaks the rock into smaller sized pieces. These small sized pieces of rock are thrown upwardly and are broken into smaller sized pieces upon impact with a complement of primary target breaker bars 22 and 23 carried by the housing 11. A secondary crushing occurs when the smaller sized pieces of rock drop downwardly from bars 22 and 23 to be struck again by the impellers 17 and 18 and thrown toward a discharge area 24 where the small broken pieces impact with a vertical array of secondary target bars 25. Close to the periphery of the rotor 12, one or more adjustable and yieldable breaker bars 26 and 27 are arranged, as is shown in U.S. Pat. No. 2,486,421. Any small pieces of rock not passing between bars 25 and into the discharge area 24 progress downwardly to the bar 27 where such pieces are subjected to a final crushing action as the pieces are nipped and urged through the space between the rotor 12 and the bar 27 to the lowest point of the discharge area. The crusher 10 may include a pivoting shell 28 connected to the base structure 29 by a hinge shaft or rod 30 to provide access to the interior of the crusher.

Figures 2, 4, 5:
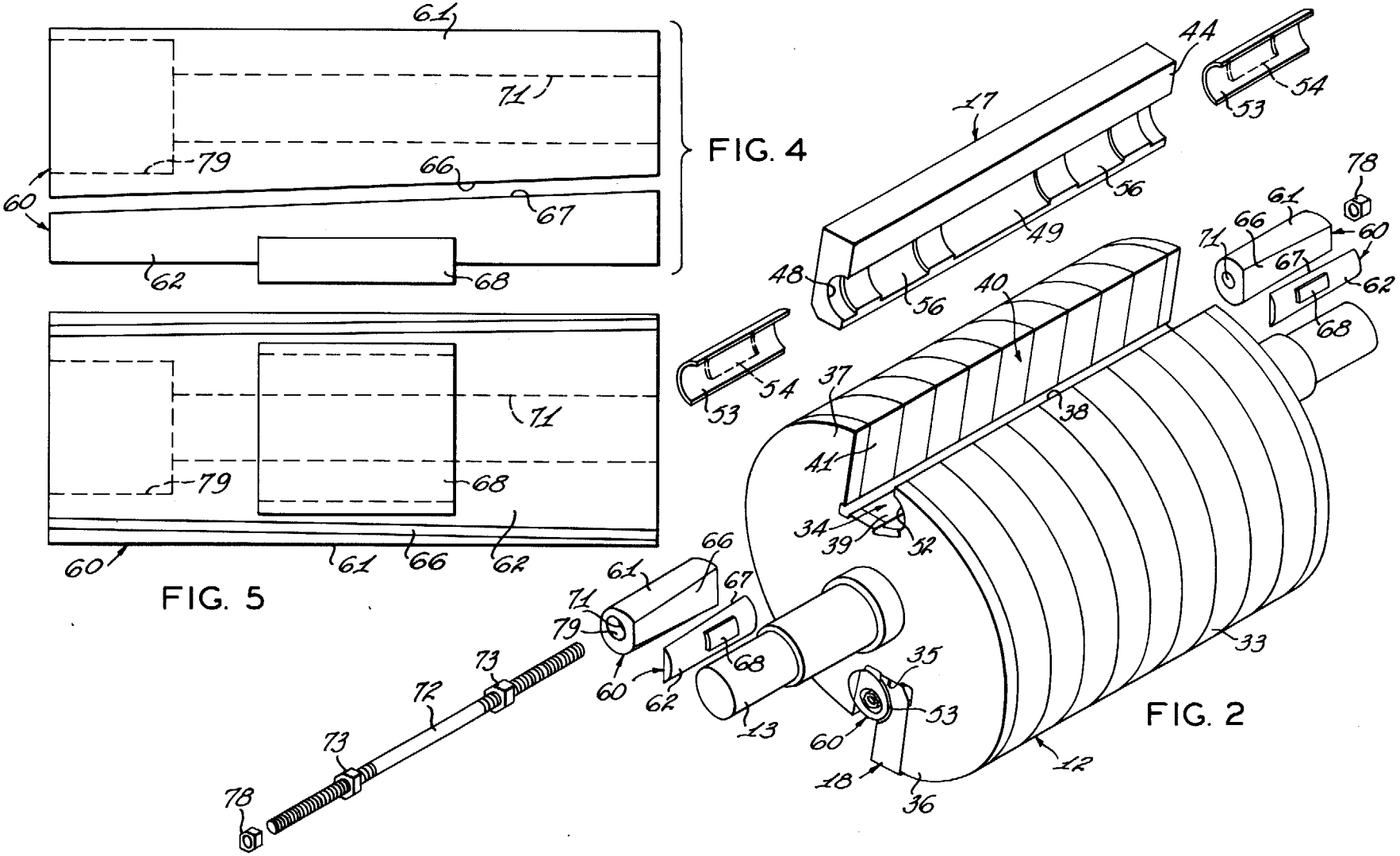
FIG. 2 is an exploded isometric view of a rotor of the impact crusher shown in FIG. 1.
FIG. 4 is a detail longitudinal view of the impeller locking means of FIG. 3 showing the relationship of the angularly formed wedging surfaces.
FIG. 5 is a view of the wedge locking means as viewed from the bottom of FIG. 4.

The rotor 12, as best seen in FIG. 2, comprises an elongated central body portion 33 having a pair of axially extending slots 34 and 35 and a pair of diametrically disposed spiral body extensions 36 and 37. As shown in FIG. 2, slot 34 is depicted as having a leading wall 38, a bottom surface or floor 39 and a back wall 40. The body extensions 36 and 37 each project progressively further radially outwardly beginning at the leading wall 38 of one slot and reaching a maximum projection at a terminus defining a planar face 41 of the back wall 40 of the other opposite slot.

The impellers or hammer means 17 and 18 are each disposed in the slots 34 and 35, respectively, and project outwardly of their respective slots with a leading impact face 44 extending outwardly from the slot so that the top thereof is at least as far as the radial outer edge of the slot face 41.

Referring to FIG. 2, a radial inner surface port 48 of the leading impeller face 44 of the impeller 17 is formed to define a concave semi-cylindrical recess 49. A generally cylindrical elongated cavity 52 is formed in the face of the leading wall 38 adjacent the floor portion 39 of the slot 34, which is parallel to the rotor shaft 13. A single piece semi-cylindrical bushing 53 is provided for insertion into the semi-cylindrical recess 49 of the impeller 17 at each end thereof. Each semi-cylindrical bushing 53 is provided with a protuberence or key 54 portion which is formed on the rear convex surface of the bushings 53. The keys 54 cooperate with recesses 56 formed in the semi-circular recess 49 in the impeller to lock the bushing in position holding it from moving axially.

Figure 3:
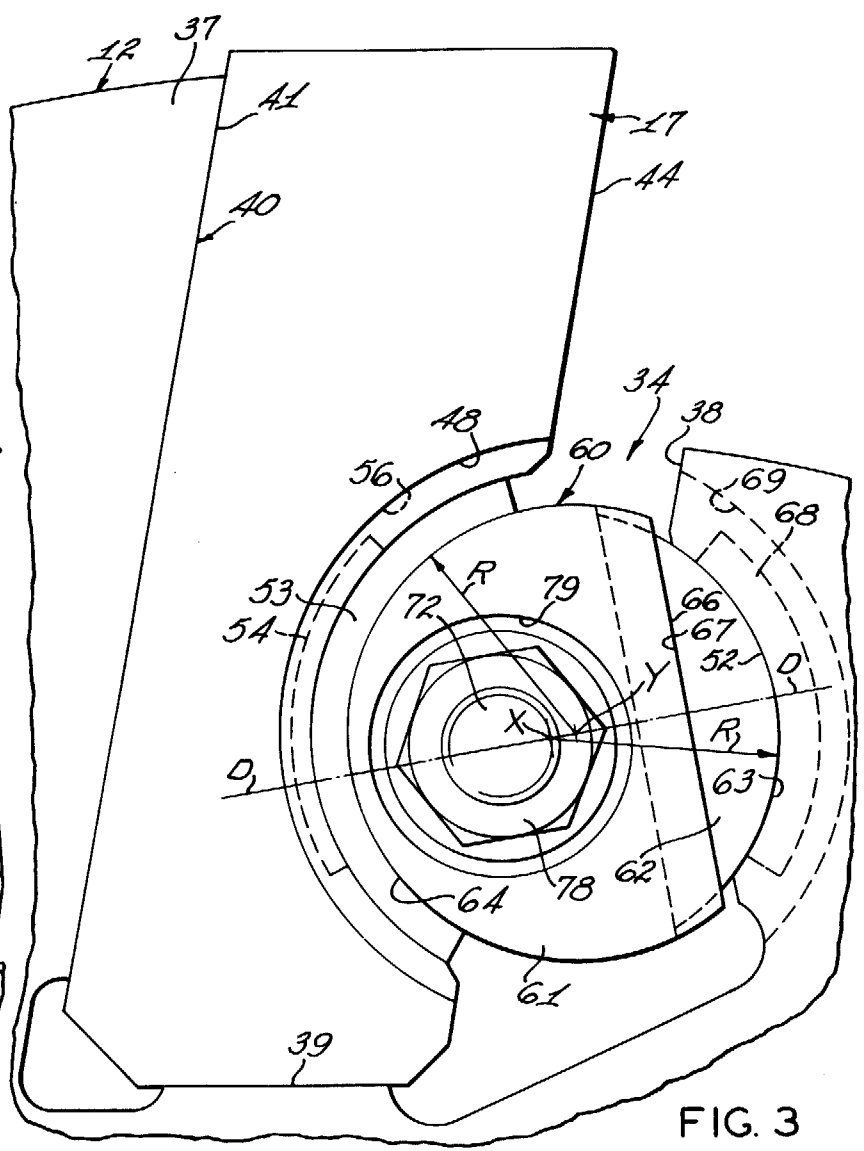
FIG. 3 is an enlarged end view of the impeller assembled in the rotor with the locking means of the present invention applied.

A two-piece wedge lock 60 is provided for each end of each of the slots 34 and 35 for locking the impellers 17 and 18, respectively, in operating position and positively holding the impellers in position in the rotor. The locking means 60, as previously mentioned, comprises a large wedge portion 61 and a smaller wedge portion 62. As shown in FIG. 3, the wedge lock 60 when in assembled condition presents a cylindrical configuration where the curved surface 63 of the smaller wedge 62 is constructed with a radius R whose center is at a point X on the diameter line D—D. The curved surface 64 of the larger wedge portion 61 is constructed with the same radius R as the radius R of the smaller wedge portion 62. However, the radius R of the larger wedge portion 61 is established from the point Y on the diameter line D—D. The two-wedge portions 61 and 62 are formed with complementary tapered surfaces 66 and 67, respectively, constructed with a preferred slope of one in 24.

As shown in FIGS. 2 and 3, the smaller wedge portion 62 is provided with a semi-cylindrical elongated key portion 68 which is welded or otherwise secured to the curved surface of the smaller wedge portion. The key 68 is adapted to be received in a recess 69 formed in the semi-circular cavity 52 of the leading wall 38. This arrangement prevents longitudinal movement of the smaller wedge portion 62 within the cavity 52.

Each of the larger wedge portions 61 has a bore 71 through which a knockout rod 72 may be inserted. The rod 72 is threaded and carries a pair of nuts 73 rigidly fixed or welded in position. As indicated in FIG. 2, the nuts 73 are located on the rod 72 in position so that they are inwardly of the wedge portions 61 and also spaced apart from the wedge portions.

In the assembly of rotor 12, the impeller 17, for example, is placed in the slot 34 abutting the floor 39 and the back wall 41. Thus, the semi-cylindrical recess 49 in the impeller 17 and the semi-circular recess 52 of the leading wall 38 cooperate to define therebetween a generally cylindrical cavity. The smaller wedge portion 62 is placed in the cavity 52 of the leading wall 38 with the key 68 engaged in the suitable recess 69. The bushing 53 is then placed in the cavity 48 of the impeller 17 with its key 54 disposed within the recess 56 of the impeller. Next, the rod 72 is placed in position and the larger wedge portions 61 inserted each into end of slot 34. The rod passes through the bore 71 of both large wedge portions and extends beyond the ends of the large wedge portions when they are in the installed position. Thus, the pair of nuts 73 will be inwardly of the larger wedge portions 61 when surfaces 66 and 67 mate. A suitable tool is slipped over the outwardly extending end of the rod 72 into abutting engagement with the outer face of the larger wedge portion 61 and the wedge portion driven into tight relationship with the smaller wedge portion 62 thereby moving both wedge portions radially outwardly into tight locking relationship.

The two parallel surfaces 66 and 67, respectively, which are machined at an angle to the outside diameter of the lock assembly 60 form the wedges which permits positive wedging for all impeller tightening ranges. This is true because a flat surface taper lock is multi-positional, whereas a cone arrangement is not. The herein disclosed wedges cannot rotate due to the radius of each of the wedge portions being centered on different locations.

To remove the impeller 17 from the rotor 12, it is necessary to remove the wedge lock assembly 60. This is accomplished by threading a suitable driving block to one end of the knock-out rod 72 and hammering the driving block. This moves the rod axially in one direction whereby an adjacent nut 73 abuts the inner end of the larger wedge portion 61. Thus, the larger wedge portion 61 will be made to move axially outwardly sliding on the surface 67 of the smaller wedge portion 62 and the semi-cylindrical concave surface of the bushing 53. The opposite wedge lock assembly 60 is removed in a similar manner.

Since the knock-out rod 72 extends outwardly of the larger wedge portions 61, advantage has been taken to provide an emergency security means. This is accomplished by threading nuts 78 onto the extending ends of the rod and recessing the nuts in suitable counterbores 79 formed in the end of the rod bore 71.

From the foregoing detailed description of the illustrative embodiment set forth herein to exemplify the present invention, it will be apparent that an improved arrangement for locking an impeller in the rotor of an impact crusher has been provided.

The embodiments of the invention in which an exclusive property or privilege is claimed are defined as follows:

1. An impeller rotor for an impact crusher having an elongated central body portion having an axis of rotation and provided with at least one axially extending peripheral slot having a leading wall surface extending the length of the rotor in which an impeller bar is arranged with a portion of the leading impeller face within the slot and a portion thereof extending outward of the slot;

an elongated semi-cylindrical cavity formed in the face of the leading wall of the slot;

an elongated semi-cylindrical cavity formed in the leading impeller face within the slot, said semi-cylindrical cavities cooperating to define a single elongated cylindrical cavity;

a two-piece wedge lock disposed within the cylindrical cavity to lock the impeller within the slot; said wedge lock including a first portion having a semi-cylindrical outer surface having a radius centered at a first location and a flat surface formed at an angle to said semi-cylindrical surface;

a second portion having a semi-cylindrical outer surface having a radius equal to the radius of said first portion but centered at a location which is different than the location of the center of the radius of said first portion; said second portion also having a flat surface formed at an angle to said semi-cylindrical surface, said flat surfaces of said first and second portions being complementary; and means to prevent axial and rotational movement of said second portion relative to said first portion within said cavity;

whereby positive wedging of the impeller within the slot is effected and rotation of the wedge lock within the cavity is effectively prevented due to the radii of the two pieces being centered at different locations.

2. An impeller rotor according to claim 1 including a semi-cylindrical bushing adapted to be received in a portion of the semi-cylindrical cavity of said impeller, said bushing being operable to receive said first portion of said wedge lock for supporting the same for axial movement; and means on the semi-cylindrical convex surface of said bushing cooperable with means in said semi-cylindrical cavity in said impeller to prevent axial movement of said bushing;

whereby axial movement of said first portion of said wedge lock may occur relative to said second portion and said first portion will slide in said bushing in so doing.

3. An impeller rotor according to claim 2 wherein said first portion of said wedge lock is larger than said second portion, and is provided with an axial bore therethrough;

a knock-out rod extending through the bore in said first portion; and abutment means in said rod in position to engage with the inwardly disposed axial face of said first portion for moving said first portion of said wedge lock out of said cylindrical cavity.

4. An impeller rotor according to claim 3 wherein there is provided a wedgc lock at both ends of said cylindrical cavity;

said first portions of each of said wedge locks being provided with coinciding axial bores;

said knock-out rod extending through the bores of each of said first portions; and abutment means adjustable along said rod and disposed inwardly of the ends of associated ones of said first but not in contact therewith;

whereby an impact blow may be applied to one end of said knock-out rods to move said rod in a first direction and said abutment on the rod will engage with a first portion of one of said wedge locks to transmit the impact blow applied to the rod to said first portion thereby driving said first portion out of said cylindrical cavity.

5. An impeller rotor according to claim 4 wherein there is provided nuts threadedly engaged on the outer ends of said knock-out rod and operable to prevent said first portions of said wedge locks from being displaced from said cylindrical cavity accidentally.

* * * * *